United States Patent [19]

Munekata et al.

[11] 4,365,446

[45] Dec. 28, 1982

[54] GUARD DEVICE FOR A GRINDING WHEEL IN A GRINDING MACHINE

[75] Inventors: Kenichi Munekata; Yasuo Suzuki, both of Kariya; Norio Ohta, Chiryu, all of Japan

[73] Assignee: Toyoda Koki Kabushiki Kaisha, Kariya, Japan

[21] Appl. No.: 228,352

[22] Filed: Jan. 26, 1981

[30] Foreign Application Priority Data

Jan. 24, 1980 [JP] Japan ..... 55-7849[U]

[51] Int. Cl.[3] ..... B24B 55/04

[52] U.S. Cl. ..... 51/268; 83/860; 83/478

[58] Field of Search ..... 51/268, 269, 272, 274; 83/478, 546, 860

[56] References Cited

U.S. PATENT DOCUMENTS 3,029,563 4/1962 Bass et al. ..... 51/268 X
3,812,752 5/1974 Jaegers ..... 83/478
3,835,595 9/1974 Oshima et al. ..... 51/268
4,024,674 5/1977 Suzuki ..... 51/268

*Primary Examiner*—James G. Smith
*Attorney, Agent, or Firm*—Oblon, Fisher, Spivak, McClelland & Maier

[57] ABSTRACT

A guard device for a grinding wheel in a grinding machine comprises a side guard plate pivotably mounted upon a guard body for covering one side face of the grinding wheel. A front cover member is slidably mounted upon the top portion of the guard body for covering the upper front portion of the grinding wheel. A latch member is mounted on the front cover member to be engaged with a saw-toothed member so as to restrict movement of the front cover member away from the periphery of the grinding wheel but to allow movement of the front cover member toward the periphery of the grinding wheel. A locking member is pivotably mounted on the top of the guard body to lock the side guard plate in a closed state. When the locking member is pivoted to be disengaged from the side guard plate, the saw-toothed member is also disengaged from the latch member.

5 Claims, 2 Drawing Figures

GUARD DEVICE FOR A GRINDING WHEEL IN A GRINDING MACHINE

BACKGROUND OF THE INVENTION

1. Field of the Invention

The present invention relates to a guard device for a grinding wheel in a grinding machine.

2. Description of the Prior Art

In general, a protective guard device is provided for covering a grinding wheel in a grinding machine for assuring safety of an operator. In order to permit a wheel exchange operation, a front cover for covering the upper front portion of the grinding wheel is adjustable in position and a side guard plate for covering one side face of the grinding wheel is pivotably mounted.

With the conventional wheel guard device, the front cover and the side guard plate were separately and independently manipulated for a wheel exchange operation, resulting in a longer wheel exchange time. Furthermore, adjustment of the front cover was a troublesome operation.

SUMMARY OF THE INVENTION

It is an object of the present invention to provide an improved guard device which is easy to manipulate.

Another object of the present invention is to provide an improved guard device capable of permitting a wheel exchange operation in a simple and rapid manner.

A further object of the present invention is to provide an improved guard device as set forth above, wherein manipulation of a locking member causes a side guard plate to be unlocked and simultaneously a front cover to be released for movement.

Briefly, according to the present invention, these and other objects are achieved by providing a guard device for a grinding wheel in a grinding machine, as described below. A guard body is provided for covering the grinding wheel rotatably mounted upon a wheel support and has a side opening. A side guard plate is pivotably mounted upon the guard body for covering the side opening. A front cover member is slidably mounted upon the top portion of the guard body for covering the upper front portion of the grinding wheel. A latch member is mounted on the front cover member. A locking member is pivotably mounted at one end thereof upon the top portion of the guard body and engageable at the other end thereof with the top portion of the side guard plate to lock the side guard plate in a closed position. A saw-toothed member is engageable with the latch member and restricts movement of the front cover member in one direction away from the periphery of the grinding wheel, but allows movement of the front cover member in the opposite direction. The saw-toothed member is operatively connected to the locking member in a manner so as to be disengaged from the latch member when the locking member is pivoted to be disengaged from the top portion of the side guard plate.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
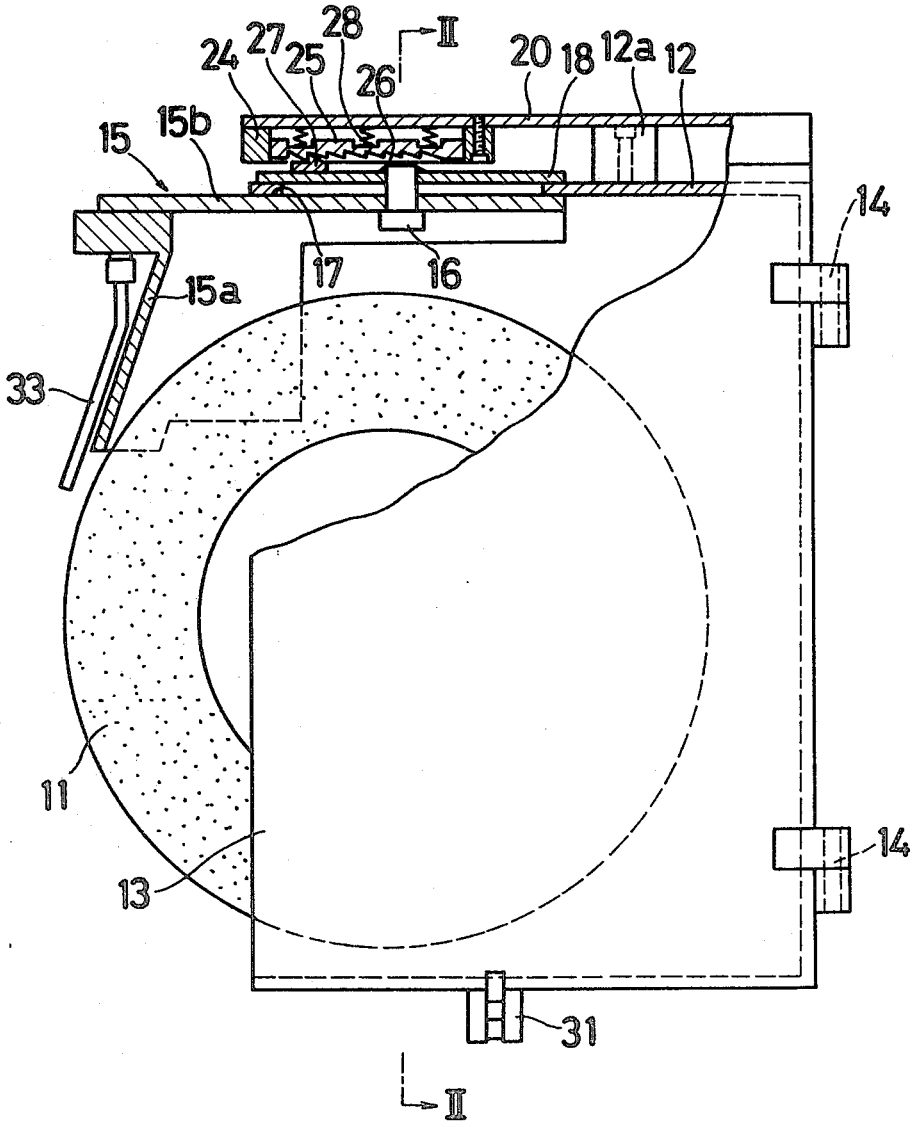
FIG. 1 is a front elevational view, partly in section, of a wheel guard device according to the present invention.
Figure 2:
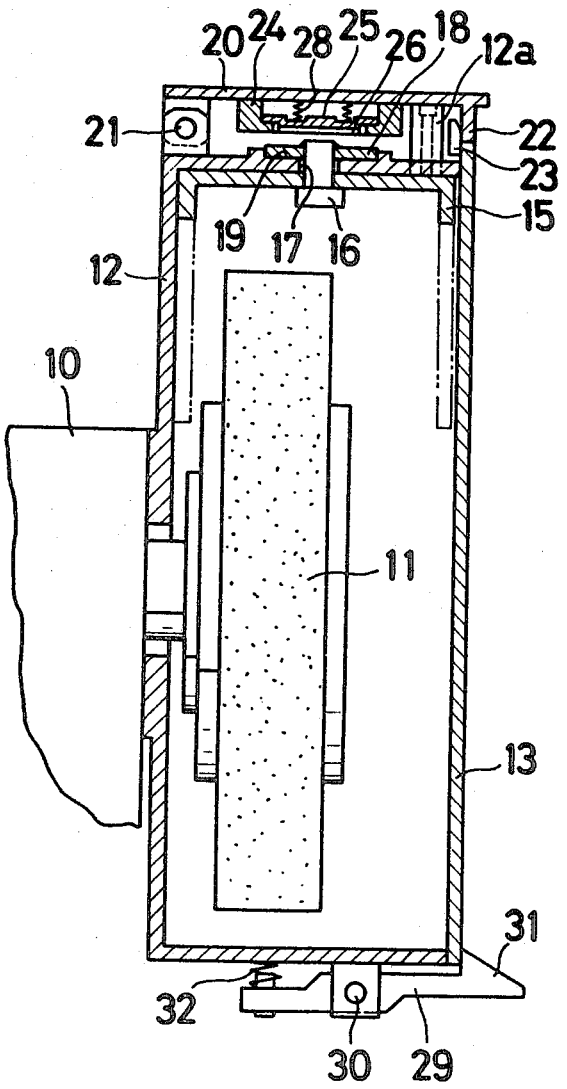
FIG. 2 is a sectional view taken along the lines II—II in FIG. 1.

Referring now to the drawings, wherein like reference numerals or characters refer to identical or corresponding parts throughout the several views, and more particularly to FIGS. 1 and 2, there is shown a grinding wheel 11 which is rotatably mounted upon a wheel support 10 of a grinding machine, and the wheel support 10 also has fixedly mounted thereon a guard body 12 for covering the upper, lower and rear portions, as well as one side face, of the grinding wheel 11. The guard body 12 has an opening at the other side face of the grinding wheel 11. A side guard plate 13 for covering the opening of the guard body 12, is pivotably mounted upon the guard body 12 through hinge pins 14 so that it may be selectively opened and closed.

A front cover 15 for covering the upper front portion of the grinding wheel 11 is slidably mounted on the top portion of the guard body 12. More specifically, the front cover 15 is provided with a forwardly sloped portion **15*a* for covering the upper front portion of the grinding wheel 11 and with a horizontal base portion 15*b* located beneath the top portion of the guard body 12. The base portion 15*b* of the front cover 15 is provided with a connecting pin 16 which extends above the top portion of the guard body 12 through an elongated hole 17 formed in the top portion of the guard body 12. A guide plate 18 is secured to the projected end of the connecting pin 16 and is slidably mounted in a guide way 19 formed on the top portion of the guard body 12, so as to permit horizontal adjustment of the front cover 15 relative to the grinding wheel 11**.

A locking member 20 is pivoted at its one end by a pivot pin 21 at the top left end of the guard body 12, as viewed in FIG. 2, so as to be pivotable about the pivot pin 21 extending in a direction parallel to the movement of the front cover 15. The locking member 20 has at its other end a bent portion 22 which is engageable with an engaging member 23 formed on the top portion of the side guard plate 13 to lock the top portion of the side guide plate 13. A stop member **12*a* is bolted on the top right end of the guard body 12, as viewed in FIG. 2, so as to support the weight of the locking member 20. The locking member 20 is provided at its underside with a casing 24 within which a saw-toothed member 25 is received in such a manner as to be restricted from horizontal movement but allowed to move in a vertical direction. The vertical movement of the saw-toothed member 25 toward the guide plate 18 is limited by the bottom portion of the casing 24. The saw-toothed member 25 is formed with a saw-tooth array which extends in the direction of movement of the front cover 15 and is exposed to the guide plate 18 through an opening 26 formed on the bottom portion of the casing 24. A plurality of springs 28 are interposed between the locking member 20 and the saw-toothed member 25 to urge the saw-toothed member 25 toward the guide plate 18. The guide plate 18 has mounted thereon a latch member 27 which is engaged with the saw-toothed member 25 when the locking member 20 is in a locked position wherein the bent portion 22 is engaged with the engaging member 23 of the side guard plate 13. When the locking member 20 is in an unlocking position wherein the bent portion 22 is disengaged from the engaging member 23, the saw-toothed member 25 is disengaged from the latch member 27. The saw-toothed member 25 and the latch member 27 are formed so that when engaged with each other they permit movement of the front cover 15 toward the periphery of the grinding wheel 11 by increments equal to the pitch of the saw tooth, but restrict movement of the front cover 15 away from the periphery of the grinding wheel 11 by engagement of the saw tooth and the latch member 27**.

A foot-operated lever 29 is pivotably supported on the bottom portion of the guard body 12 by means of a pivot pin 30. The foot-operated lever 29 is provided at its one end with a latch portion 31 which is engageable with the bottom portion of the side guard plate 13 to lock the same. A spring 32 is interposed between the bottom portion of the guard body 12 and the end of the foot-operated lever 29 to urge the latch portion 31 upward toward the lower portion of the side guard plate 13. Reference numeral 33 indicates a coolant nozzle secured to the front cover 15 for supplying coolant to the periphery of the grinding wheel during a grinding operation.

The operation of the guard device according to the present invention will now be described. During a grinding operation, the bent portion 22 of the locking member 20 and the latch portion 31 of the pivot member 29 are respectively engaged with the top and bottom portions of the side guard plate 13 to maintain the side guard plate 13 in a closed state, which assures a safe grinding operation. As the grinding wheel 11 is decreased in diameter as a result of dressing operations thereon, the front cover 15 is intermittently manually pushed toward the periphery of the grinding wheel 11 by distances each corresponding to one pitch of the saw-toothed member 25, to thereby maintain a predetermined distance between sloped portion 15*a* of the front cover 15 and the periphery of the grinding wheel 11.

When the grinding wheel 11 is reduced into a predetermined diameter as a result of successive grinding operations, the grinding wheel 11 has to be exchanged for a fresh one having a larger diameter. In order to perform this exchange operation, the foot-operated lever 29 is first trodden by an operator to discharge the latch portion 31 from the bottom portion of the side guard plate 13, and then the locking member 20 is lifted to disengage the bent portion 22 and the saw-toothed member 25 from the top portion of the side guard plate 13 and the latch member 27, respectively. Thereafter, the side guard plate 13 is opened and the front cover 15 is moved away from the periphery of the grinding wheel 11 to permit exchange of the grinding wheel 11 in a simple and rapid manner. It is to be noted that the locking member 20 rests on the stop member 12*a*, after the side guard plate 13 is opened and the front cover 15 is moved away from the periphery of the grinding wheel 11.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A guard device for a grinding wheel in a grinding machine comprising:

a guard body for covering said grinding wheel, said grinding wheel being rotatably mounted upon a wheel support, and said guard body having a side opening;

a side guard plate pivotably mounted upon said guard body for covering said side opening;

a front cover member slidably mounted upon the top portion of said guard body for covering the upper front portion of said grinding wheel;

a latch member mounted on said front cover member;

a locking member pivotably mounted at one end thereof upon the top portion of said guard body and engageable at the other end thereof with the top portion of said side guard plate to lock said side guard plate in a closed position wherein said side opening is covered;

a saw-toothed member engageable with said latch member to restrict movement of said front cover member in one direction away from the periphery of said grinding wheel, but to allow movement of said front cover member in the opposite direction, said saw toothed member being operatively connected to said locking member so as to be disengaged from said latch member when said locking member is pivoted to be disengaged from the top portion of said side guard plate.

2. A guard device as claimed in claim 1, wherein the top portion of said guard body has an elongated hole formed therein and wherein said front cover member has secured thereto one end of a connecting pin extending through said elongated hole, wherein a guide plate is securedly connected to the other end of said connecting pin and slidably mounted on the top portion of said guard body, and wherein said latch member is mounted on said guide plate.

3. A guard device as claimed in claim 2, wherein said locking member has secured at the underside thereof a casing member within which said saw-toothed member is received, said casing being formed such that said saw-toothed member is restricted from horizontal movement but allowed to move in a vertical direction, and wherein spring means is interposed between the underside of said locking member and said saw-toothed member to urge said saw-toothed member toward said latch member.

4. A guard device as claimed in claim 1, 2 or 3, further comprising:

a foot-operated lever pivotably mounted on the bottom portion of said guard body;

spring means interposed between the bottom portion of said guard body and one end of said foot-operated lever for urging the other end of said foot-operated lever toward engagement with the bottom portion of said side guard plate to lock said side guard plate in a closed position.

5. A guard device as claimed in claim 4, wherein said guard body has secured at the top portion thereof a stop member for supporting the weight of said locking member.

* * * * *